US006126586A

United States Patent [19]

Herrou et al.

[11] Patent Number: 6,126,586

[45] **Date of Patent: *Oct. 3, 2000**

[54] DEVICE FOR IMPROVING FOLDING ACCURACY IN A FOLDER

[75] Inventors: Eric Herrou, Thiverny; Franck Bausela, Creil, both of France

[73] Assignee: Heidelberger Druckmaschinen AG, Heidelberg, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 09/031,978

[22] Filed: Feb. 26, 1998

[30] Foreign Application Priority Data

Feb. 26, 1997 [FR] France ..... 97 02297

[51] Int. Cl.[7] ..... B41F 13/56

[52] U.S. Cl. ..... 493/360; 493/353

[58] Field of Search ..... 493/353, 357, 493/359, 360, 370, 425–429, 432

[56] References Cited

U.S. PATENT DOCUMENTS

| | | | |
|---|---|---|---|
| 2,031,780 | 2/1936 | Lamatsch | 493/360 |
| 4,279,410 | 7/1981 | Bolza-Schunemann | 493/427 X |
| 4,368,879 | 1/1983 | Hoshi | 493/432 X |
| 4,465,269 | 8/1984 | Petersen | 493/425 X |
| 4,917,665 | 4/1990 | Couturier | 493/359 X |
| 5,484,379 | 1/1996 | Stab | 493/359 |
| 5,520,378 | 5/1996 | Kepert et al. | 493/420 X |

*Primary Examiner*—David A. Scherbel
*Assistant Examiner*—Anthony Ojini
*Attorney, Agent, or Firm*—Herbert L. Lerner; Laurence A. Greenberg; Werner H. Stemer

[57] ABSTRACT

A folder having at least one folding unit with at least two mutually cooperating product-carrying cylinders, the folder having further folding attachments, and devices for increasing cutting accuracy, includes retaining elements engageable with at least one material web for retaining the web, and a rotating support surface assigned to one of the product-carrying cylinders within a transfer region, the rotating support surface serving to support the web when it is engaged by the retaining elements.

11 Claims, 3 Drawing Sheets

DEVICE FOR IMPROVING FOLDING ACCURACY IN A FOLDER

BACKGROUND OF THE INVENTION

Field of the Invention

The invention relates to a folder having at least one folding unit including at least two mutually cooperating product-carrying cylinders, the folder having further folding attachments, and devices for increasing cutting accuracy.

The prior art, as exemplified by the published German Patent Document DE 39 32 931 A1, discloses a folding jaw cylinder formed, between adjacent folding jaws thereof, with flats or cavities closable, if necessary, by elastic coverings. The cavities are arranged in a manner that, when folding bars and grooved bars, respectively, pass through the nip between the puncturing and folding knife cylinder and the folding jaw cylinder, the cavities are located opposite the bars. Consequently, so to speak, a widening of the nip occurs, so that any occurring stoppages or blockages and any paper accumulations, respectively, can pass through the nip between the cylinders, without either of the cylinders being damaged thereby. At the remaining circumferential regions, an enlargement of the nip is made possible by the fact that adjusting devices are guided in eccentrically mounted pins. In the case of a paper jam, these segments are thus able to yield. Also in the region of the grooved bars and cutting bars, respectively, a widening of the nip is achieved by the respective flats or cavities when the bars pass through the nip.

German Patent 671 790 is concerned with a cutting and collecting device for rotary printing presses. At a collecting cylinder, three grooved bars located on the latter can be continuously and automatically displaced alternatingly forward and backward, respectively, in the circumferential direction in accordance with the changing positions of cutting lines of respective cutting knives. Through this solution, the grooved bars can be adjusted so that they coincide with the respective cutting line of the cutting knives. Consequently, both the wear on the grooved bars can be reduced and the accuracy of the cutting operation can be increased.

In the case wherein the folders, respectively, have two folding units disposed, for example, above one another, wherein an incoming material web can undergo a longitudinal cut or wherein a plurality of material webs can run in, a partial web or entire material web to be fed to the lower folding unit follows a relatively long path, as a result of which, because of a deflection at a plurality of rollers, web tension fluctuations may result, which can lead to an inaccurate, namely slit-like, execution of the punctures, and which, in addition, are accompanied by an inaccurate cutting operation when respective copies are severed from the partial web or from the entire material web. Because of the relatively long transport path leading to the lower folding unit, losses in quality with respect to cutting accuracy and folding position of the folded copies produced by the lower folding unit can result.

SUMMARY OF THE INVENTION

It is accordingly an object of the invention to provide a device for improving puncturing and transverse cutting accuracy at folding-unit cylinders of a folding unit which is much superior to corresponding devices heretofore known in the prior art.

With the foregoing and other objects in view, there is provided, in accordance with the invention, a folder having at least one folding unit including at least two mutually cooperating product-carrying cylinders, the folder having further folding attachments, and devices for increasing cutting accuracy, comprising retaining elements engageable with at least one material web for retaining the web, and a rotating support surface assigned to one of the product-carrying cylinders within a transfer region, the rotating support surface serving to support the web when it is engaged by the retaining elements.

In accordance with another feature of the invention, the folder includes a drive for the rotating support surface.

In accordance with a further feature of the invention, the drive for the rotating support surface is a cylinder.

In accordance with an added feature of the invention, the drive includes a separate drive transmission for rotating the support surface.

In accordance with an additional feature of the invention, the drive includes a cutting cylinder for driving the rotating support surface via a drive transmission.

In accordance with yet another feature of the invention, the rotating support surface is formed with mutually spaced circumferential grooves.

In accordance with yet a further feature of the invention, the circumferential grooves formed on the rotating support surface extend opposite to the retaining elements.

In accordance with yet an added feature of the invention, the circumferential grooves formed on the rotating support surface are arranged in groups.

In accordance with yet an additional feature of the invention, the rotating support surface is mounted in bearing elements fastenable on side walls of the folder.

In accordance with a concomitant feature of the invention, the folder includes another folding unit, the one folding unit and the other folding unit being arranged above one another.

Due to the features of the invention, it is possible, in an advantageous manner, to achieve more precise puncturing of a partial stream or of a bundle of material webs, formed of several superimposed multilayer material webs, following the passage thereof over a relatively long transport path. Depending upon the degree of deflection of the material webs at deflection rolls on this transport path, it is possible for different web tensions to be eliminated before the transverse or crosscut upstream of the lower folding unit. The rotating support surface in the puncturing region upstream of the crosscut of the material web by the cutting blades counteracts any lateral drifting of the web, which has hitherto been extremely disadvantageous for accurate cutting.

In advantageous developments of the principle upon which the invention is based, it is possible for the rotating support surface to be driven. Frictional driving by the material web would also be conceivable. It is also possible for the rotating support surface to be driven by a further cylinder in the folder cylinder part or by a deflection roller. Furthermore, it is also possible for the rotating support surface to be equipped with a separate drive or drive transmission, which may be flange-mounted on a side wall of the folder or folder cylinder part. In order to avoid damage to the extensible and retractable retaining elements, the rotating support surface is provided with circumferential grooves, into which leading tips of the retaining elements enter during the puncturing operation. The entry of the retaining elements into the circumferential grooves of the rotating support surface additionally ensures that the material web covering the circumferential grooves is completely pierced by the retaining elements, and the material web can be accommodated reliably and completely on the circumference of the product-carrying cylinder. On the rotating support surface, the circumferential grooves can be combined into groups which correspond to the arrangement of the retaining elements on the product-carrying cylinder.

In addition to construction thereof as a continuously extending roll, the rotating support surface may also be formed of a plurality of disk-like elements, which can be arranged alongside one another. In addition, the arrangement of the disks as a rotating support surface would permit the width of the support surface to be adapted to or matched with the width of the respective material web to be processed.

Other features which are considered as characteristic for the invention are set forth in the appended claims.

Although the invention is illustrated and described herein as embodied in a device for improving folding accuracy in a folder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
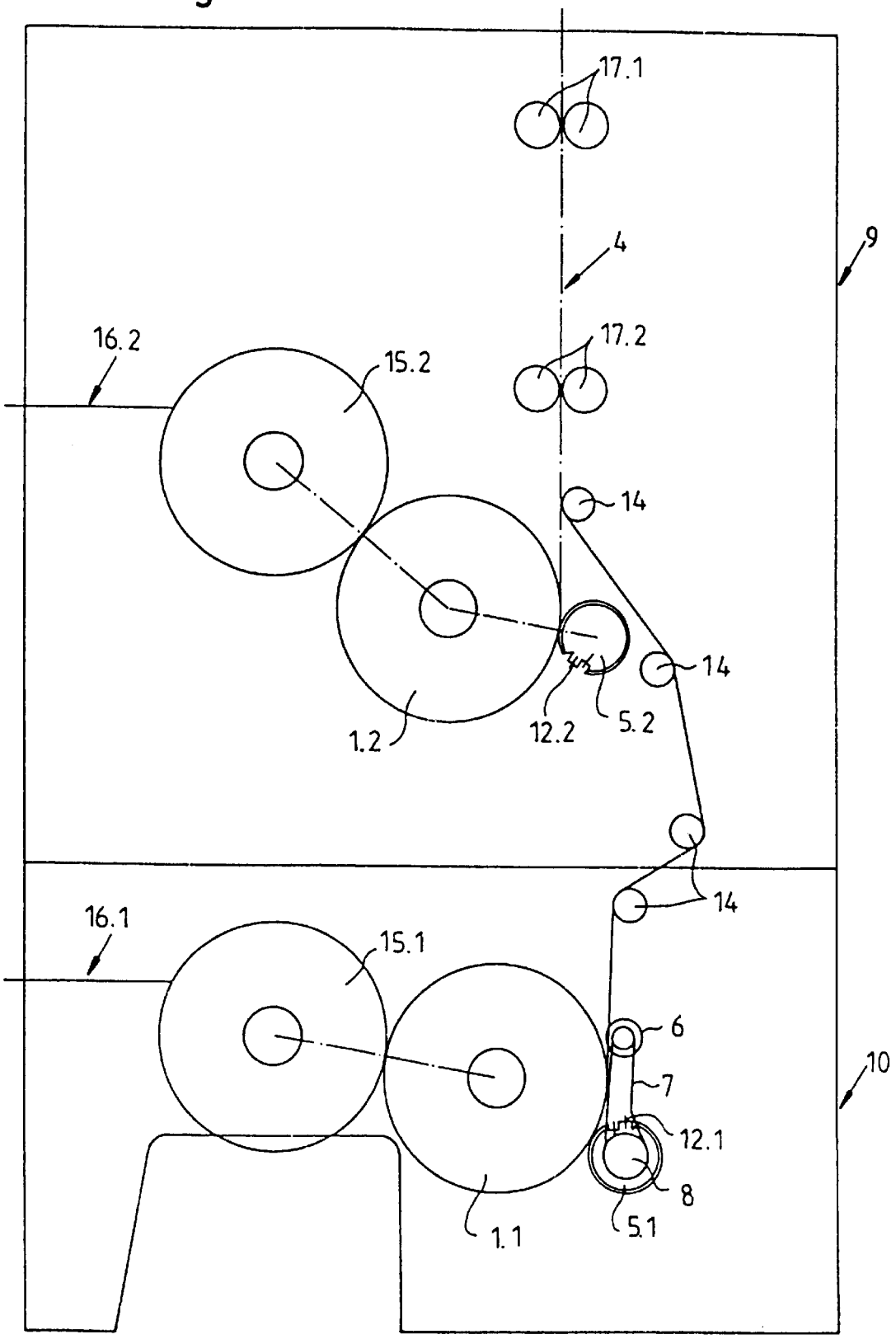
FIG. 1 is a highly diagrammatic elevational view of a folder cylinder part having mutually separated folding units which are disposed above one another.

Referring now to the drawings and, first, particularly to FIG. 1 thereof, there is shown therein a cylinder part of a folder having an upper folding unit 9 and a lower folding unit 10. A material web 4 which runs into the upper folding unit 9, and may also be a plurality of material webs or web streams, is kept under tension by two pairs of tensioning rollers 17.1 and 17.2 which that are located above one another. Part of the material webs 4 are led into the lower folding unit 10 over a first deflection roller or rollers 14.

By longitudinal cutting devices provided at the first deflection roller or rollers 14, a longitudinally folded material web 4 can be divided into individual partial streams, of which some are further processed in the upper folding unit 9, and others are led into the lower folding unit 10. A plurality of material webs 4 can also be processed in the folder configuration according to FIG. 1; then, whether or not division into partial streams is effected by longitudinal cutting devices, some material webs 4 can be processed in the upper folding unit 9, and other material webs in the lower folding unit 10.

After passing the first deflection roller or rollers 14, the material webs 4 or partial streams which are led into the upper folding unit 9 are transversely cut and transversely folded therein. A cutting knife 12.2, which is fastened on the upper cutting cylinder 5.2, severs copies from the material web or webs 4, which are subsequently picked up on or accepted by the outer surface of an upper transfer cylinder 1.2. The transfer or tucker blade cylinder 1.2, which contains a folding knife and gripper device and is not otherwise illustrated in greater detail, cooperates with an upper folding jaw cylinder 15.2, which conveys the cross-folded copies to a diagrammatically represented upper product delivery 16.2 and delivers them thereon.

The material webs 4 or partial streams led into the lower folding unit 10 are guided to a lower transfer or tucker blade cylinder 1.1 over further deflection rollers 14. The outer surface of the lower transfer cylinder 1.1 has a rotating support surface 6 assigned thereto.

In the exemplary embodiment shown in FIG. 1, the rotating support surface 6 is driven by a drive belt 7 via a drive wheel 8 fitted on a lower cutting cylinder 5.1. Retaining elements 3, not shown in FIG. 1 but illustrated in detail in FIGS. 2 and 3, grip the material web 4 before a copy is severed from the latter by the lower cutting knife 12.1 of the lower cutting cylinder 5.1. During the passage of the material web or material webs 4, the rotating support surface 6 ensures that the retaining elements 3 of the lower transfer cylinder 1.1 actually penetrate the material web or webs 4, and do so completely at an accurately determined point, with the result that, in the case of a plurality of material webs 4, for example, even the outermost material web, facing away from the outer surface of the lower transfer cylinder 1, is pierced and reliably gripped. The rotating support surface 6 prevents the material web 4 from moving away when the retaining elements 3 extend out of the lower transfer cylinder 1.1. The rotating support surface 6 serves as a counterpart to the material web 4 during the puncturing of the latter, the material web 4 being supported on the counterpart, so that an accurate puncturing operation can be performed.

The copies initially picked up on or accepted by the outer surface of the lower transfer cylinder 1.1 are passed on, in the course of further processing thereof, to a folding jaw cylinder 15.1, from which they are delivered, in cross-folded form, onto a lower product delivery 16.1.

Figure 2:
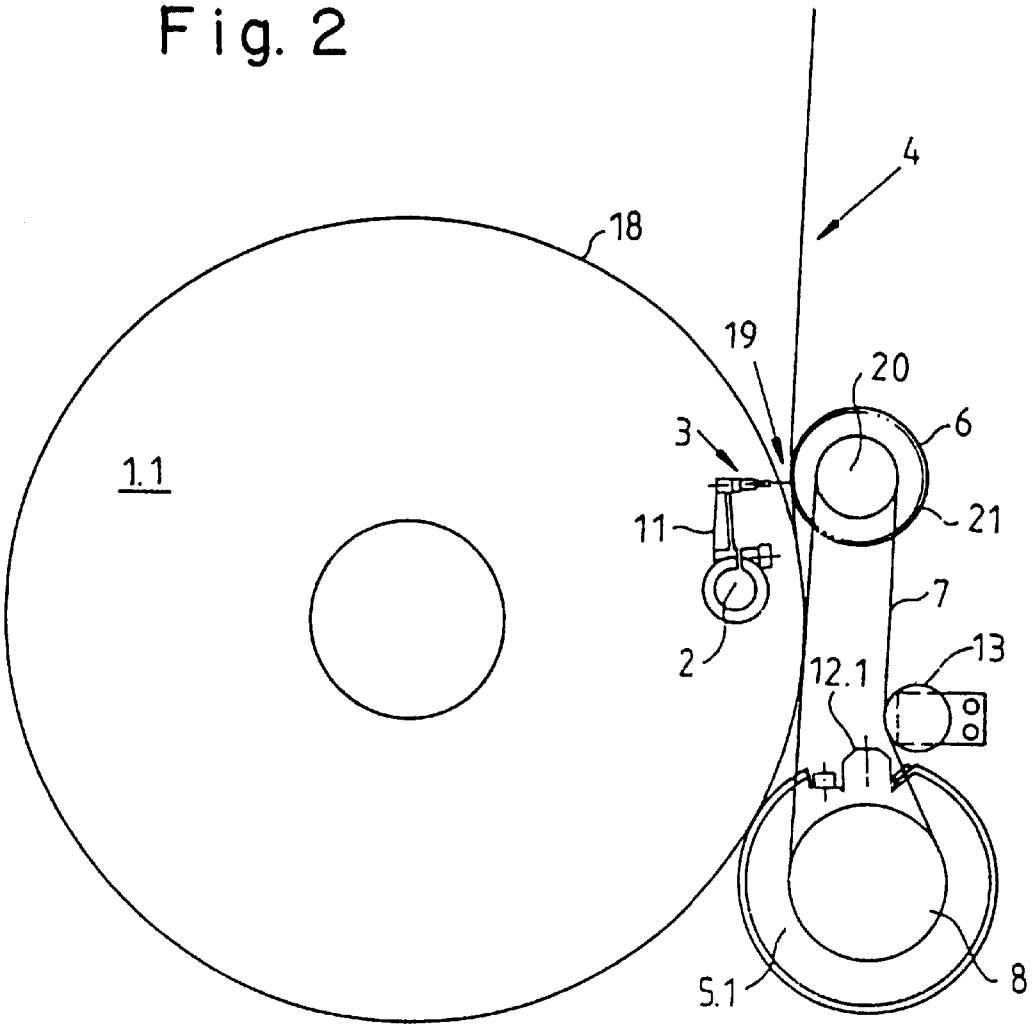
FIG. 2 is an enlarged fragmentary view of FIG. 1 showing a rotating support surface, assigned to a cylinder casing or outer cylindrical surface of a copy or product-carrying cylinder and shown in this figure as being driven by a further cylinder.

Illustrated in FIG. 2 is a rotating support surface 6, which is assigned to a cylinder casing or outer cylindrical surface 18 of a product-carrying cylinder 1.1 and, in Fig, 2, is being driven by a further cylinder. Retaining elements 3 in the form of impaling pins are extensively and retractably mounted in the product-carrying lower transfer cylinder 1.1. The retaining elements 3 are fastened on levers 11, which are mounted alongside one another on an actuating shaft 2. When the actuating shaft 2 is rotated, whether under cam control or by a motor is immaterial, the individual retaining elements 3 either extend out of the outer surface 18 of the transfer cylinder 1.1 or retract back into the latter; when the retaining elements 3 are extended out of the outer surface 18 of the product-carrying transfer cylinder 1.1 in a puncturing region 19, one or more material webs 4 which are located in that region 19 are initially pressed only slightly against the rotating support surface 6 which is disposed in the puncturing region 19. When the retaining elements 3 are extended farther out of the outer surface 18 of the product-carrying cylinder 1.1, the material web 4 cannot move any farther away, with the result that it can be punctured completely by the retaining elements 3. The tips of the retaining elements 3 fully pierce the material web 4 located in the puncturing region 19 and, in so doing, the tips of the retaining elements 3 dip or enter into circumferential grooves 21, which are formed on the surface of the rotating support surface 6. In the exemplary embodiment shown in FIG. 2, the rotating support surface 6 is driven via the lower cutting cylinder 5.1 by a drive belt transmission 7 revolving on two drive wheels 8 and 20, with the result that no relative speeds can occur between the material web or webs 4, on the one hand, and the rotating support surface 6, on the other hand. A pre-tensioning of the drive belt 7 can be maintained or readjusted, in particular, by tensioning rollers 13. The drive of the rotating support surface 6 at the conveying speed of the material web or material webs 4 has the effect that no ink can be deposited on the rotating outer cylindrical support surface 6, and that scratching or setting off of the outermost side of the material web 4 does not occur.

By means of the ratio of the diameters of the respective drive wheels or drive pulleys 8 and 20, it is possible for the rotational speed of the rotating support surface 6 to be set accurately to the conveying speed of the material webs 4. Although, by way of example, a different embodiment of the drive which originates from the lower cutting cylinder 5.1 is illustrated in FIG. 2, the rotating support surface 6 can also be driven by the lower transfer cylinder 1.1 or another product-carrying cylinder or by deflection rollers. Furthermore, it would also be conceivable to drive the rotating support surface 6 by a separate drive, which could be flange-mounted on one end of the support surface 6.

Figure 3:
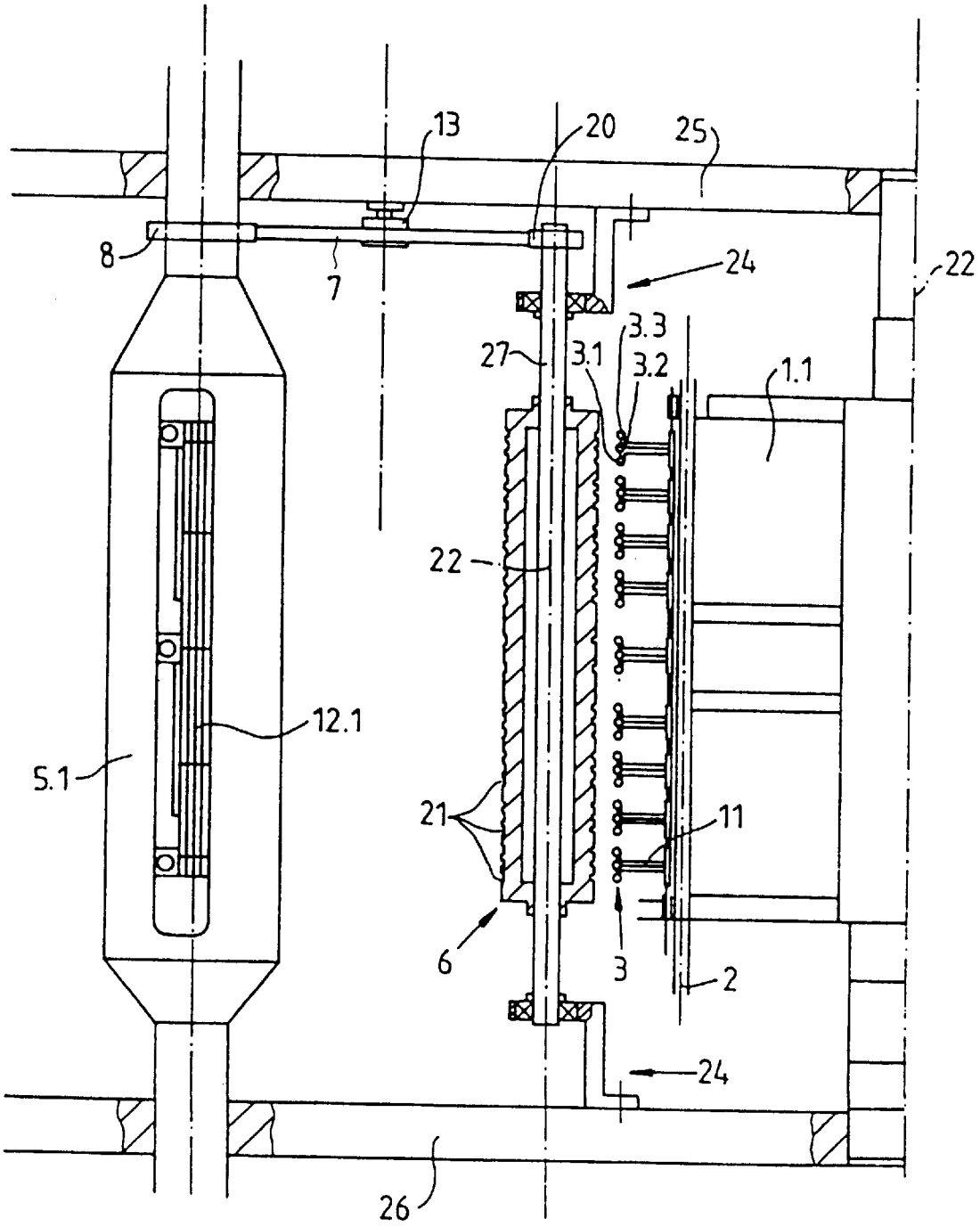
FIG. 3 is a front elevational view of FIG. 2, as seen from the righthand side thereof and rotated 90° counterclockwise, of a different embodiment of the drive for the rotating support surface, which is accommodated on side walls of the folder cylinder part.

FIG. 3 is a view, partially reproduced in an extended stretched form, of a further embodiment of the drive for the rotating support surface 6 which, as shown in this figure, is mounted on the side walls of the folder cylinder part. The rotating support surface 6 is mounted in bearing elements 24 on both side walls 25 and 26 of the folder cylinder part, and is driven via a drive belt 7. The belt 7 revolves around the drive pulleys 8 and 20 and sets the shaft 27 of the rotating support surface 6 rotating. Instead of the drive wheel 20, it would be possible to provide a separate drive on the shaft 27.

In addition to the implementation of the rotating support surface 6 as a continuous roller, it would also be conceivable to form the support surface 6 of a plurality of disks, to be mounted alongside one another, in the circumferential surfaces of which, the circumferential grooves 21 according to FIG. 3 would have to be formed. The roller body of the rotating support surface 6 may be formed of metal, plastic, rubber or the like.

Furthermore, as illustrated, FIG. 3 clearly shows that the retaining elements 3, shown therein as individual impaling needles 3.1, 3.2 and 3.3, are located opposite circumferential grooves 21 of the rotating support surface 6. The circumferential grooves 21 are arranged on the rotating support surface 6 in groups of three, respectively, because the circumferential grooves 21, respectively, are disposed opposite retaining elements 3 having three impaling needles 3.1, 3.2 and 3.3. If retaining elements 3 having more or less individual needles were used, then the quantity or number and the group arrangement of the circumferential grooves 21 on the outer rotating support surface 6 would change correspondingly. It should also be noted that the axes of rotation of the rotating support surface 6 and of the product-carrying transfer cylinder 1.1 are identified by reference character 22.

We claim:

1. A folder comprising:

a folding unit including at least two mutually cooperating product-carrying cylinders, one of said at least two mutually cooperating product-carrying cylinders defining a first cylinder having an interior and including retaining elements with impaling pins mounted in said interior; and a rotating support surface assigned to said first cylinder within a transfer region, said rotating support surface formed with spaced apart circumferential grooves cooperating with said impaling pins, said rotating support surface serving to support the web when it is engaged by said impaling pins.

2. The folder according to claim 1, including a drive for said rotating support surface.

3. The folder according to claim 2, wherein said drive for said rotating support surface is a cylinder.

4. The folder according to claim 2, wherein said drive includes a drive belt transmission for rotating said support surface.

5. The folder according to claim 2, wherein said drive includes a cutting cylinder for driving said rotating support surface via a drive transmission.

6. The folder according to claim 1, wherein said circumferential grooves formed on said rotating support surface extend opposite to said retaining elements.

7. The folder according to claim 1, wherein said circumferential grooves formed on said rotating support surface are arranged in groups.

8. The folder according to claim 1, wherein said rotating support surface is mounted in bearing elements fastenable on side walls of the folder.

9. The folder according to claim 1, including another folding unit, the one folding unit and the other folding unit being arranged above one another.

10. The folder according to claim 1, wherein said impaling pins are moveably mounted to be extended outside of said interior of said first cylinder and to be retracted within said interior of said first cylinder.

11. The folder according to claim 1, wherein said impaling pins are disposed in groups and said spaced apart circumferential grooves are formed in groups.

* * * * *